US006203474B1

(12) United States Patent
Jones

(10) Patent No.: US 6,203,474 B1
(45) Date of Patent: Mar. 20, 2001

(54) MULTI-FUNCTION EXERCISE MACHINE

(75) Inventor: Gary Allen Jones, Daytona Beach, FL (US)

(73) Assignee: Brunswick Corporation, Franklin Park, IL (US)

( * ) Notice: Subject to any disclaimer, the term of this patent is extended or adjusted under 35 U.S.C. 154(b) by 0 days.

(21) Appl. No.: 09/103,219

(22) Filed: Jun. 23, 1998

(51) Int. Cl.[7] ..... A63B 21/06
(52) U.S. Cl. ..... 482/97
(58) Field of Search ..... 482/94, 97–100, 482/137, 138, 204, 134

(56) References Cited

U.S. PATENT DOCUMENTS

| | | | | |
|---|---|---|---|---|
| 4,765,611 | * | 8/1988 | MacMillan | 482/98 |
| 4,765,614 | * | 8/1988 | Shute | 482/134 |
| 4,911,435 | | 3/1990 | Johns . | |
| 5,135,449 | * | 8/1992 | Jones | 482/97 |
| 5,135,456 | * | 8/1992 | Jones | 482/97 |
| 5,554,089 | * | 9/1996 | Jones | 482/97 |
| 5,707,323 | | 1/1998 | Simonson . | |

OTHER PUBLICATIONS

Leverage Machines by Nautilus Instruction Manual pp. 16–17: Rowing Plus Machine RCVD in PTO Nov. 4, 1994.*

* cited by examiner

*Primary Examiner*—John Mulcahy
(74) *Attorney, Agent, or Firm*—Mayer, Brown & Platt

(57) ABSTRACT

A multi-function exercise machine includes a base structure that defines an exercise position. A lever is provided on the base structure for pivotal movement about an axis. The axis is located between opposite end portions of the lever. A handle is associated with the lever so as to be engaged by an exerciser to move the handle about the axis in an upward direction to a raised position and in a downward direction toward to a raised position and in a downward direction toward a lowered position. A first connector is provided on one end portions of the lever to apply selectively a first resistance against movement of the handle in the upward direction. A second connector is provided on the opposite end portion of the lever to apply selectively a second resistance against movement of the handle in the downward direction.

13 Claims, 5 Drawing Sheets

MULTI-FUNCTION EXERCISE MACHINE

FIELD OF THE INVENTION

The present invention relates to a multi-function exercise machine. Particularly, this invention is directed to an exercise machine wherein the exerciser may perform a variety of different exercise maneuvers from a standing position or, possibly, from a wheelchair or the like.

BACKGROUND OF THE INVENTION

Various exercise machines for strength training are known. Applicant has invented and developed a number of weight training exercise machines designed to accommodate more naturally the musculoskeletal structure of the human body with respect to the performance of particular muscular movement. These inventions are shown and described in the following U.S. Patents: U.S. Pat. No. 5,044,631 entitled "Decline Press Exercise Machine" issued Sep. 3, 1991; U.S. Pat. No. 5,044,632 entitled "Dumbbell Press Exercise Machine" issued Sep. 3, 1991; U.S. Pat. No. 5,050,873 entitled "Pulldown Exercise Machine" issued Sep. 24, 1991; U.S. Pat. No. 5,066,003 entitled "Leg Curl Exercise Machine" issued Nov. 19, 1991; U.S. Pat. No. 5,066,004 entitled "Leo Extension Exercise Machine" issued Nov. 19, 1991; U.S. Pat. No. 5,106,080 entitled "Leg Press Exercise Machine" issued Oct. 21, 1995; U.S. Pat. No. 5,125,881 entitled "Rear Deltoid Exercise Machine" issued Jun. 30, 1992; U.S. Pat. No. 5,135,449 entitled "Rowing Exercise Machine" issued Aug. 4, 1992; U.S. Pat. No. 5,135,456 entitled "Low Row Exercise Machine" issued Aug. 4, 1992; U.S. Pat. No. 5,171,198 entitled "Lateral Raise Exercise Machine" issued Dec. 15, 1992; U.S. Pat. No. 5,180,354 entitled "Rotary Cuff Exercise Machine" issued Jan. 19, 1993; U.S. Pat. No. 5,181,896 entitled "Incline Press Exercise Machine" issued Jan. 26, 1993; U.S. Pat. No. 5,273,504 entitled "Behind the Neck Pulldown Exercise Machine" issued Dec. 28, 1993; U.S. Pat. No. 5,273,505 entitled "High Row Exercise Machine" issued Dec. 28, 1993; U.S. Pat. No. 5,554,084 entitled "Abdominal/Hip Flex Exercise Machine" issued Sep. 10, 1996; U.S. Pat. No. 5,554,089 entitled "Military Press Exercise Machine" issued Sep. 10, 1996; U.S. Pat. No. 5,554,090 entitled "Calf Exercise Machine" issued Sep. 10, 1996; and U.S. Pat. No. RE35,470 (reissuance of U.S. Pat. No. 5,181,896) entitled "Incline Press Exercise Machine" issued Mar. 4, 1997.

Generally, the exercise machines shown and described in the foregoing patents include one or more rotatable levers which are engaged by an exerciser, usually by the hand or leg, to move the lever through an exercise plane which is oriented at specific angles or positions with respect to the torso of the body. The movement path of the lever is designed to minimize stress and discomfort on the musculoskeletal joints, while maximizing the muscular benefit achieved via performance of the exercise motion.

One of the above-identified U.S. patents, specifically U.S. Pat. No. RE35,470 (reissuance of U.S. Pat. No. 5,181,896) entitled "Incline Press Exercise Machine," relates to an exercise machine which enables an exerciser to perform a chest press exercise motion from a standing position or a seated position. When the exercise machine covered by this patent does not include the seat, and the exercise is performed from a standing position, the exerciser achieves additional muscular benefit in the stomach and upper leg muscles due to the need to stand and brace the weight of the body against the pushing motion. The standing version of the exercise machine covered by this patent has become particularly popular with football players who play on the offensive line, because the standing press motion mimics the motion used during pass blocking. While the same upper body muscles could be worked via performance of the same motion from a seated position, a more natural feel is achieved and abdominal and rear end muscles are more naturally worked via performance of this exercise from a standing position.

However, these strength training machines are generally directed to a specific exercise or to develop a specific muscle group. Consequently, a strength training machine having a greater number of functions, therefore, is desirable. Exercise equipment having multiple stations have been developed to provide a variety of different exercise motions. Conventional "multistation" equipment generally includes a large profile and is therefore typically not practical for home use. Multipurpose exercise equipment having a smaller floor profile is preferred. Moreover, conventional multipurpose exercise equipment generally does not include the benefit of standing during the performance of an exercise.

It is thus an object of the present invention to further expand upon the principle of performing a prescribed exercise motion from a standing position, and to provide multiple functions from a single strength training machine.

Traditionally, a number of health clubs have used wall mounted weighted pulleys to enable an exerciser to move a weight stack upwardly by moving a handle from the wall, with the exerciser being in a standing position during the movement. Depending upon the orientation of the exerciser with respect to the wall, the handle can either be pulled away from the wall toward the body, or pushed away from the body and the wall. In the former case, the exerciser would typically be standing in a position where he or she is facing the wall, while in the latter example, the exerciser would typically be standing in a position wherein he or she is facing outwardly from the wall. With either motion, the exerciser achieves some muscular benefit in the abdominal and rear end muscles because the exercise pulling or pushing motion is performed from a standing position. Nevertheless, although this arrangement enables an exerciser to perform either a pushing or a pulling motion, it is not capable of being used for the performance of simultaneous pushing and pulling with opposite hands. Thus, the versatility of this type of device relates primarily to the ability of the exerciser to move the handle to any desired position and free space. But that versatility can also cause some problems because inexperienced exercisers or perhaps those rehabilitating an injury may have difficulty in confining and controlling the exercise movement within a desired path, because the handle will always be subject to a force vector directed straight toward the pulley at the top of the weight stack.

It is, therefore, another object of the present invention to improve upon the degree of control an exerciser has over the motion path of an exercise device used in a pushing or pulling motion, particularly when performed in a standing mode.

For various athletes involved in weight training via the use of exercise machines or devices of various types, it is common for the exerciser to use the machine or device to exercise a muscle group against a weight resistance via movement of an arm or leg in a first prescribed direction, and then to subsequently use reverse or opposite movement, to work the same muscle group in an opposite direction. In addition, exercise movements commonly referred to as negatives may also be performed. A negative involves adding resistance to the exercise beyond what the exerciser could normally handle in a positive direction, but which is moved by the exerciser in the opposite direction to the starting point of the exercise. Typically, the performance of "negatives" is done with the assistance of one or more other exercisers, or "spotters" who may actually apply manual resistance to the machine or device to prevent its movement back to its normal at rest position.

Although the muscular benefits achieved via the performance of "negatives" can play an important role in the muscular development of an athlete, the manual application of resistance to an exercise machine or device by one or more spotters can create a dangerous situation, or it can increase wear and tear on the exercise machine or device. Even if negative resistance is applied by an experienced spotter, maximum muscular benefit may not be achieved due to inconsistency in the application of the negative resistance. In other words, most exercise machines or devices are simply not adapted for performance of "negatives."

Although some specific rehabilitation equipment improves upon the degree of control of the application of "negative resistance," such machines are usually quite bulky and fairly expensive due to this inclusion of various electronic controls such as timers, resistance measuring devices, etc. Thus, while such machines are helpful for an athlete performing a specific exercise for a specific muscle group during rehabilitation, such devices are not versatile enough or simply too expensive to be purchased for everyday use in a weight training or exercise facility.

It is thus still another objective of the invention to improve safety concerns related to the performance of a reverse exercise movement, and to do so in a manner which is sufficiently cost effective to enable everyday use and affordability for conventional exercise facilities or gyms, including home gyms.

With the increased awareness of the benefits of strength and cardiovascular training, more individuals are turning to strength training machines as a means to assist in the recovery from an illness or injury. In addition, more individuals are using exercise equipment for physical and occupational therapy. As a result, there remains a need for exercise equipment capable of enhancing rehabilitation through the use of exercises that provide controlled twisting and lifting exercises. In order to be useful for physical and occupational therapy, such equipment should also permit those wheelchair bound individuals access to the benefits of a multi-station exercise equipment that permits twisting and lifting exercise motions.

It is therefore another objective of the present invention to provide a multi-function exercise equipment that includes enhancement of twisting and lifting exercises while at the same time being wheelchair accessible.

SUMMARY OF THE INVENTION

The purpose and advantages of the invention will be set forth in and apparent from the description and drawings that follow, as well as will be learned by practice of the invention. Additional advantages of the invention will be realized and attained by the elements of the apparatus and method described.

To achieve these and other advantages and in accordance with the purpose of the present invention, as embodied and broadly described herein, a new and useful exercise machine is provided. In accordance with one aspect of the invention, the multi-function exercise machine includes a base structure that defines an exercise station for an exerciser. A lever is provided on the base structure for pivotal movement about an axis. The axis is located between opposite end portions of the lever. A handle is associated with the lever and is positioned proximate a first side of the exercise station so as to be engaged by the exerciser to move the handle about the axis in an upward direction toward a raised position and in a downward direction toward a lowered position. A first connector is provided on one end portion of the lever to apply selectively a first resistance against movement of the handle in the upward direction. A second connector is provided on the opposite end portion of the lever to apply selectively a second resistance against movement of the handle in the downward direction.

Another aspect of the invention includes a base structure defining an exercise station for an exerciser having a first side and a second side. A first lever is provided on the base structure proximate the first side of the exercise station for pivotal movement about a first axis. A second lever is provided on the base structure proximate the second side of the exercise station for pivotal movement about a second axis. The first lever and the second lever each have a handle associated therewith, with the handle for the first lever being positioned proximate the first side of the exercise station so as to be engaged by the exerciser to move the handle about the first axis in an upward direction toward a raised position and in a downward direction to a lowered position. The handle for the second lever is positioned proximate the second side of the exercise station so as to be engaged by the exerciser to move the handle about the second axis in an upward direction toward a raised position and in a downward direction toward a lowered position. A first means for applying resistance against pivotal movement by the exerciser of the first lever is provided to resist movement selectively in either of the upward direction and the downward direction. A second means for applying a resistance against pivotal movement by the exerciser of the second level to resist movement selectively in either of the upward direction and the downward direction is also provided.

The present invention achieves the above-stated objectives via a multi-function exercise machine which permits positive/reverse exercise motion for opposite sides of the body, from a standing position or from a seated position such as in a wheelchair, so that an exerciser may exercise the same muscle groups on opposite sides of the body via positive and reverse motions along prescribed exercise motion paths such that the muscle groups on one side of the body can be exercised following which the muscle groups of the other side of the body can be exercised. Advantageously, when observed, the present invention also permits simultaneous exercise of the same muscle groups on opposite sides of the body positively and then reversely. Additionally, the exercise machine of the present invention also permits simultaneous positive/reverse exercise motion for opposite sides of the body.

Because the multi-function exercise machine of this invention is particularly suitable for use by an exerciser in the standing position, or a standing mode, in addition to upper body exercise the exerciser also achieves muscular benefit for the abdominal muscles and muscles of the rear end. Additionally, by performing the pushing and the pulling exercise motions from a standing position, the exerciser is able to improve his or her balance.

Moreover, the novel invention disclosed herein allows performance of the pushing and the pulling motions either individually or simultaneously to create a twisting effect on the torso of the exerciser, particularly when in the standing mode, thereby to further achieve muscular benefit for the abdominal and mid-section muscles of the exerciser.

Preferably, the planes of motion prescribed by the exercise machine of the present invention converge with respect to the forward facing direction of the exerciser, so that both the pushing and the pulling motions are performed along paths which more naturally accommodate the musculoskeletal structure of the human body.

Because of the particular physical arrangement of the exercise machine of this invention, which includes a frame made of two frame sections located on opposite sides of a midplane, with levers carried on either of the two frame sections that are capable of being selectively loaded to resist upward or downward movements, the exercise machine is particularly suitable for performing a pushing motion on one side of the machine while simultaneously performing a pulling motion on the opposite side. In effect, the pushing motion is the reverse motion or opposite of the pulling motion, and vice versa. When the pulling motion and pushing motion are performed simultaneously, the exerciser achieves the dual benefits of positive and opposite movement of the muscles of the muscle groups located on opposite sides of the body.

Because each separate side of the machine is specifically adapted for performing either a pushing or a pulling motion, a separate mirror image "pull/push" machine is used to perform pulling and pushing with the opposite hands. Thus, when used together, the exercise machine provides positive/opposite exercise motion for the muscle groups on both sides of the exerciser, for both the pulling and the pushing motions. In other words, the exercise machine accommodates both positive and reverse, or opposite, motion along the same relative prescribed motion paths.

Therefore, by using the exercise machine, this invention minimizes the need for the use of spotters to manually apply physical resistance to an exercise machine in order for an exerciser to perform "reverse" exercises. Moreover, the exercise machine of this invention enables opposite or reverse motion to be performed in a relatively cost effective manner, because the machine itself is designed to be relatively simple from a structural standpoint, so that it is as easy to understand and use as other exercise machines typically used in a weight training facility. Because the paths of motion are prescribed by the exercise machine, these opposite exercise motions may be performed in a manner which does not increase wear and tear on the exercise machine or introduce a risk factor typically associated with manual application of reverse resistance to a pivotal lever.

It is to be understood that both the foregoing general description and the following detailed description are exemplary and provided for purposes of explanation only, and are not restrictive of the invention.

BRIEF DESCRIPTION OF THE DRAWINGS

The accompanying drawings, which are incorporated in and constitute a part of this specification, illustrate a preferred embodiment of the invention, and together with the description, serve to explain the principles of the invention.

DETAILED DESCRIPTION OF THE DRAWINGS

Figure 1:
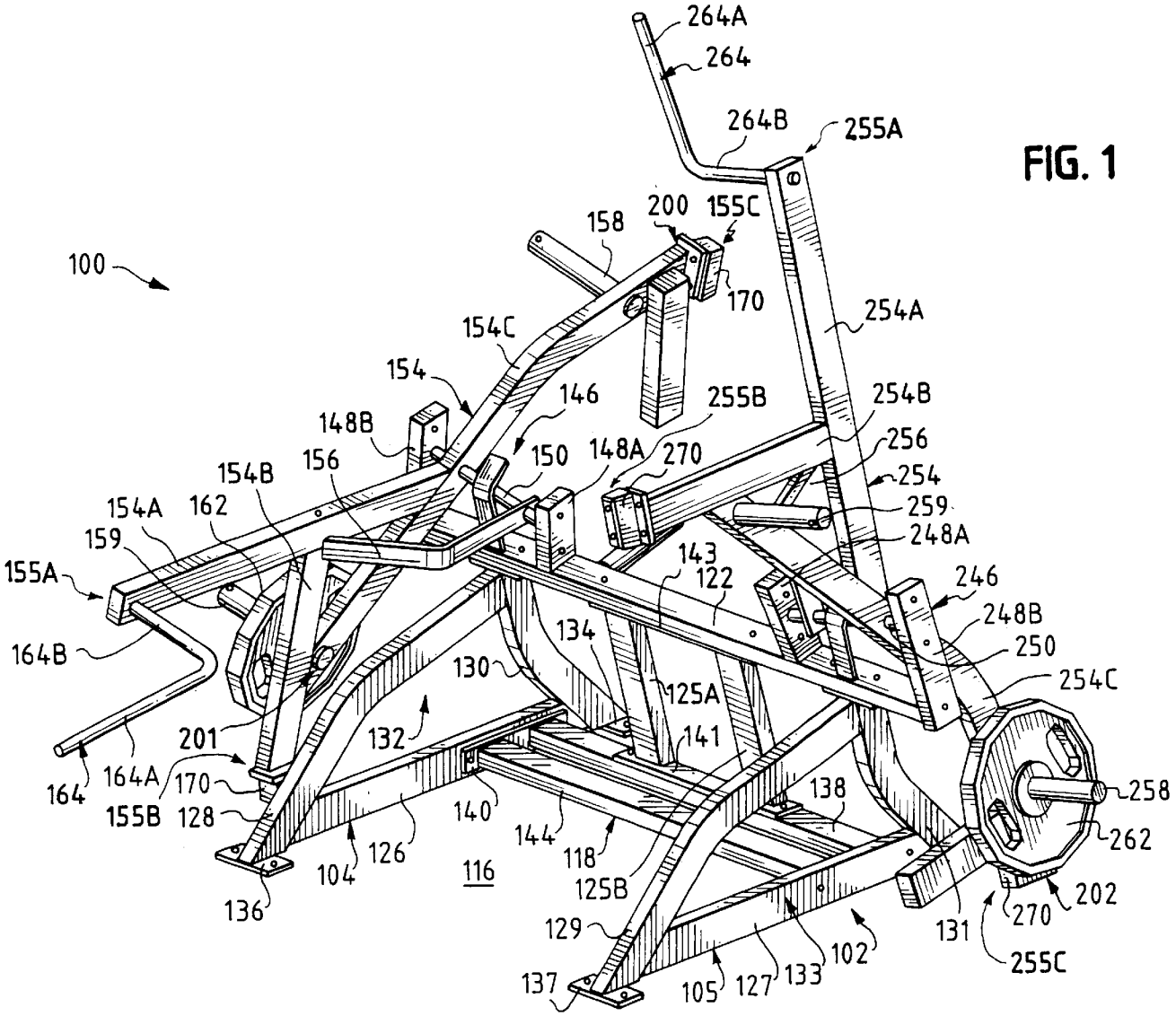
FIG. 1 is a perspective view of a representative embodiment of the multi-function exercise machine of the present invention as viewed from the front right side.
Figure 2:
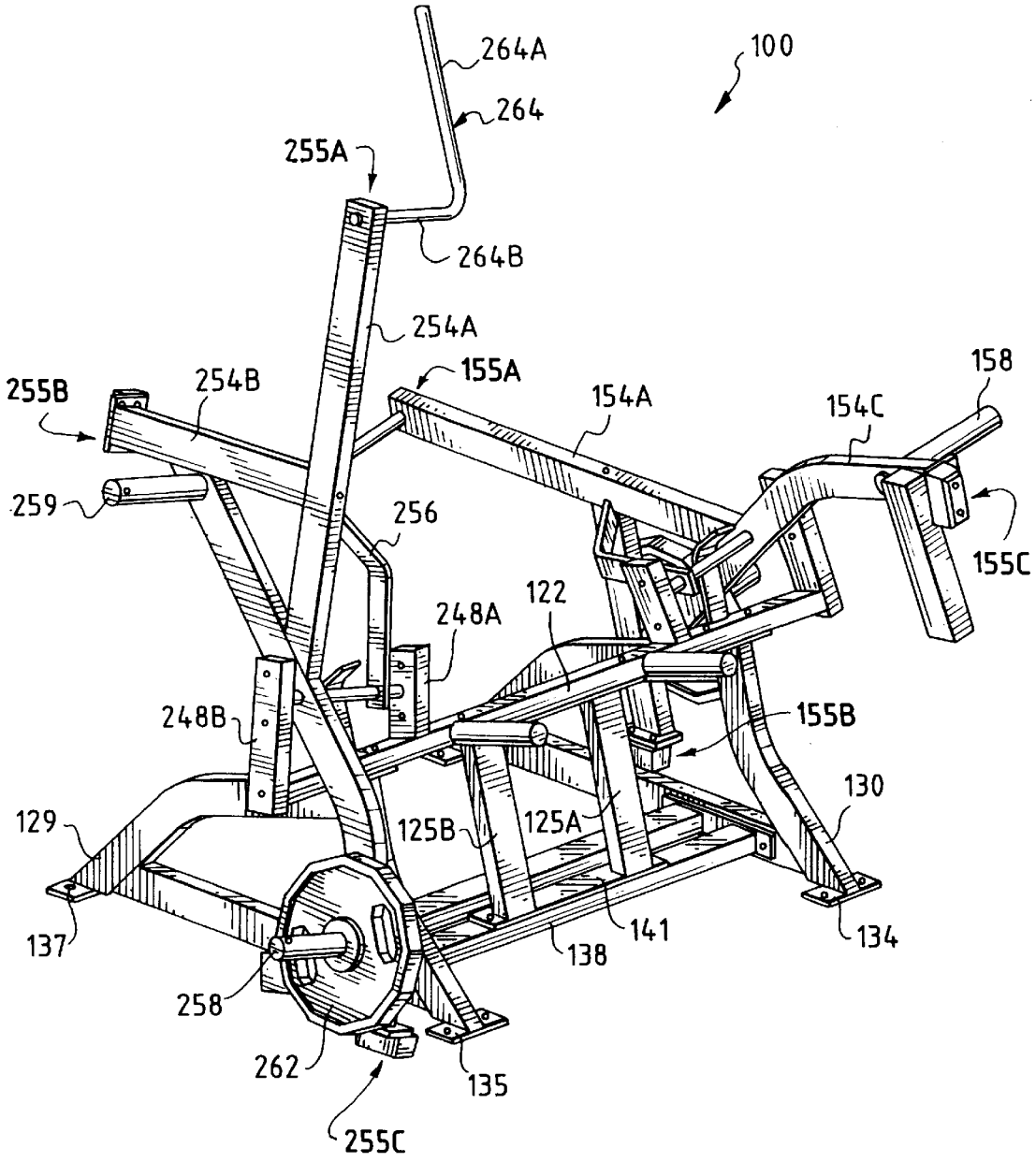
FIG. 2 is a perspective view of the multi-function exercise machine constructed in accordance with a preferred embodiment of the invention, as viewed from the front left side of the exercise machine.
Figure 3:
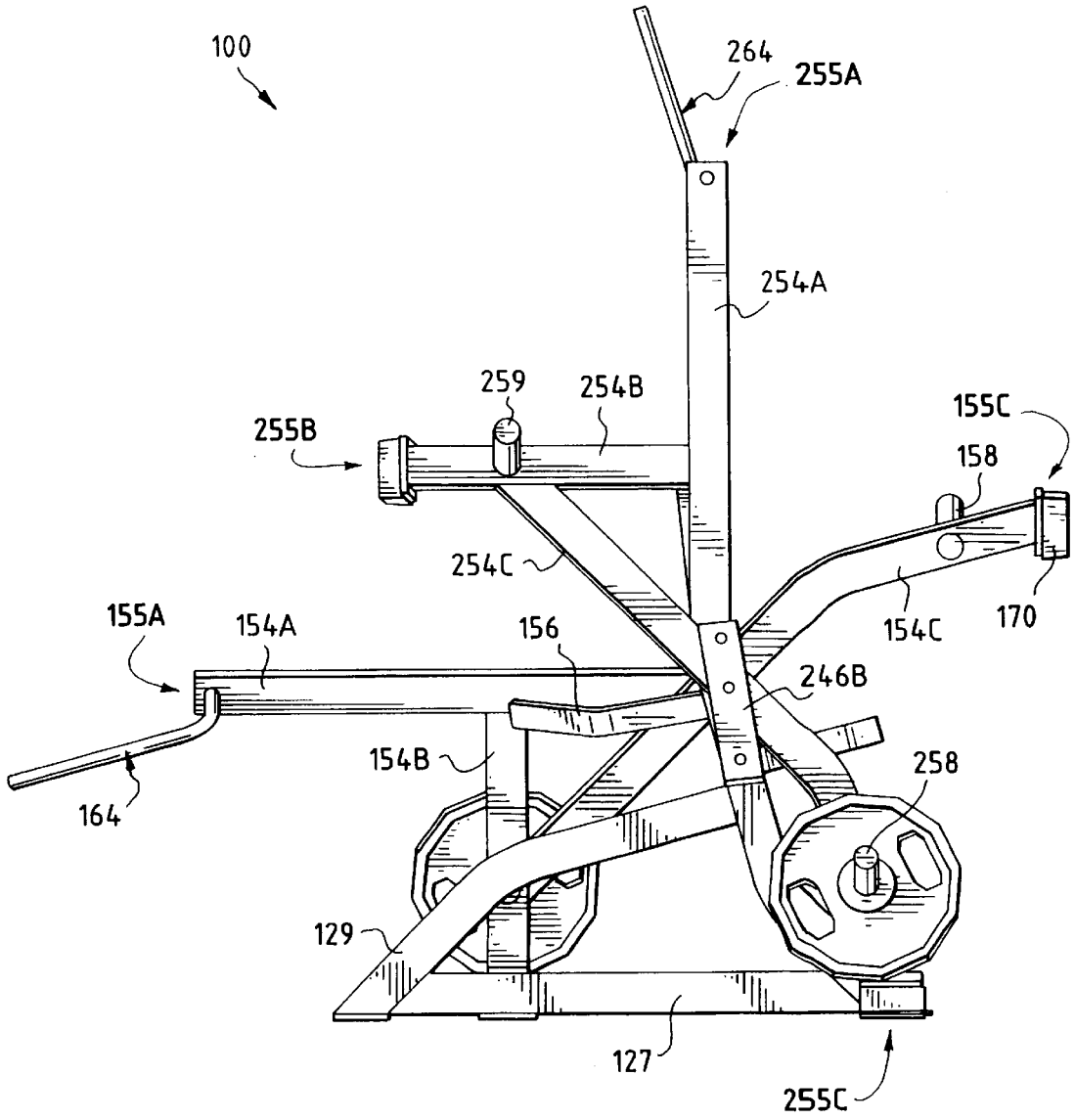
FIG. 3 is a side view of the multi-function exercise machine shown in FIG. 1.

Reference will now be made in detail to a preferred embodiment of the multi-function exercise machine of the present invention, examples of which are illustrated in the accompanying drawings. Wherever possible, the same reference characters will be used throughout the drawings to refer to the same or like parts. The method of using the present invention will be described in conjunction with the detailed description of the multi-function exercise machine.

Structure of the Multi-Function Exercise Machine

Figure 4:
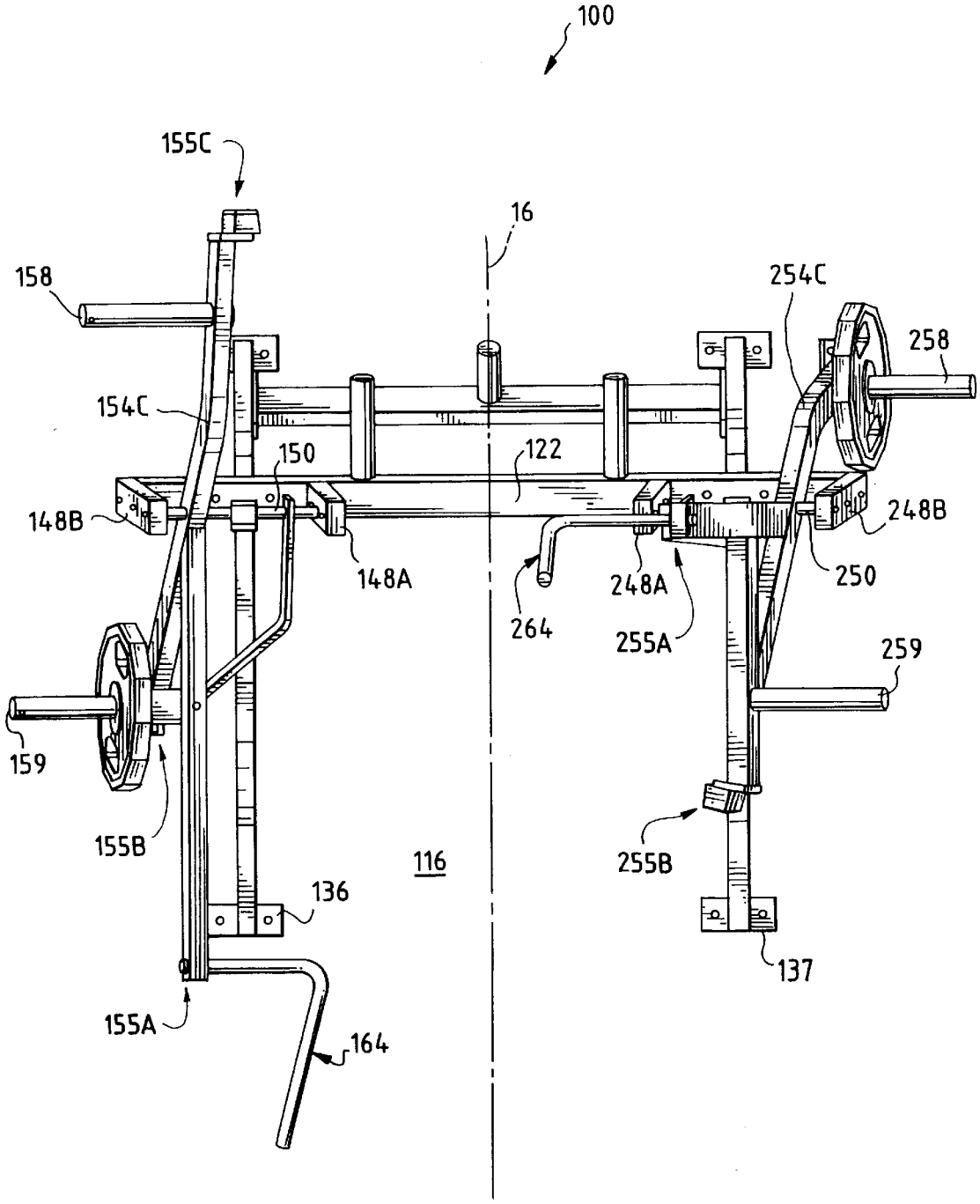
FIG. 4 is a plan view, from the top, of the multi-function exercise machine shown in FIG. 1.
Figure 5:
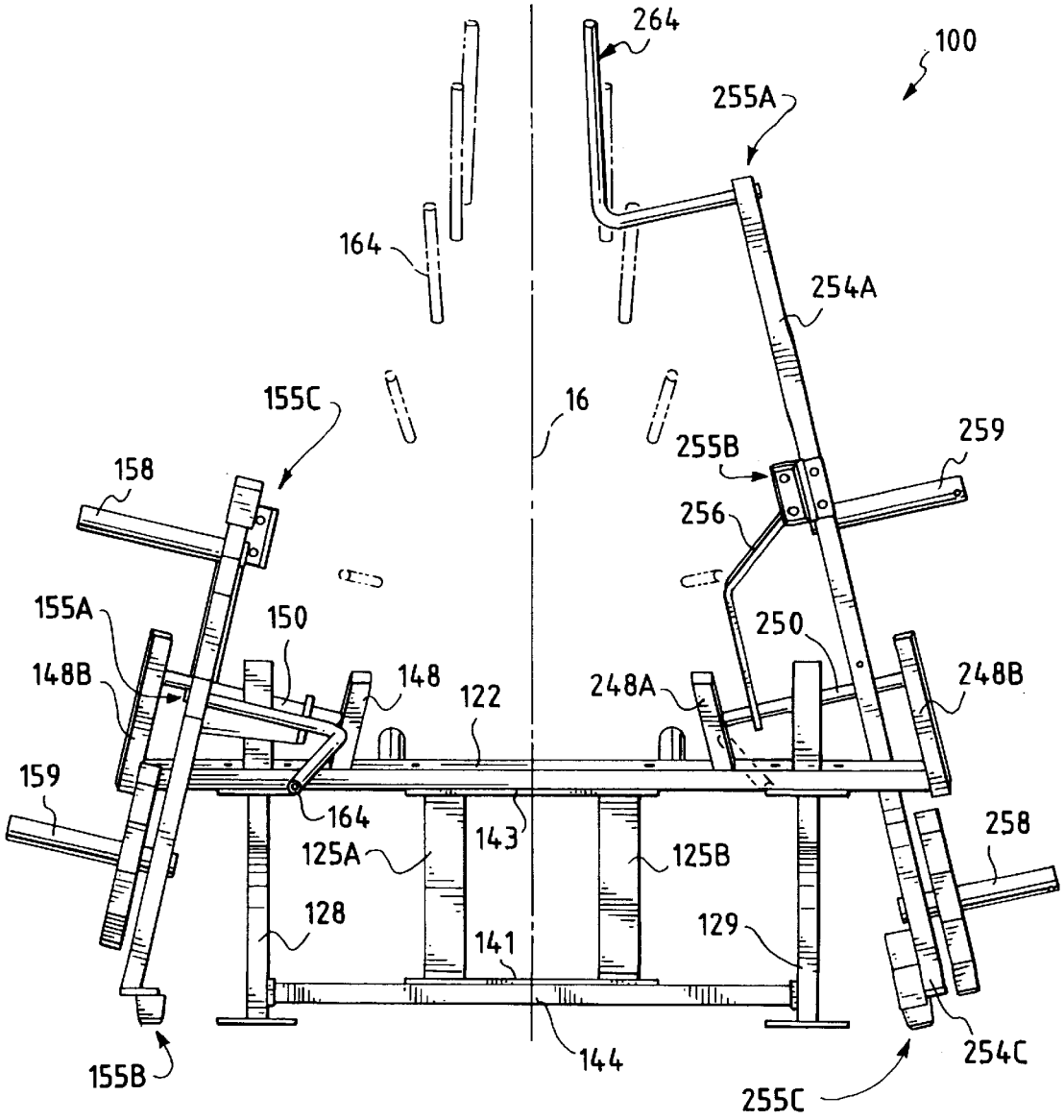
FIG. 5 is a plan view from the top of the multi-function exercise machine shown in FIG. 1 illustrating relative movement of the handle.

For purpose of illustration and not limitation, FIGS. 1–4 show a representative embodiment of the multi-function exercise machine of the present invention, which is designated generally by reference character 100. In accordance with one aspect of the invention, the multi-function exercise machine 100 includes a base structure 102 constructed of steel components similar to applicant's prior patents, and as will be readily understood by those skilled in the art. Base structure 102 includes a first frame section 104 and a second frame section 105 located on opposites sides of a vertical midplane 16 (the midplane 16 is best shown in FIG. 4). The first and second frame sections 104, 105 and the midplane 16 define, or surround, an exercise position 116, as best shown in FIG. 1. As illustrated in the preferred embodiment, no structure is present which would impede access to the exercise position by an individual in a wheelchair.

Structurally, the base structure 102 includes a rearward connector 118 which interconnects the first frame section 104 and the second frame section 105. Generally, the first frame section 104 and the second frame section 105 are similar in construction. The first frame section 104 includes a center support 126. A first angled upright 128 and a back angled upright 130 extend upwardly from the center support 126, thereby defining an enclosed triangle. This construction generally defines the base 132 of the first frame section 104. The base 132 also includes a forward support plate 134 and a rearward support plate 136.

The second frame section 105 resides opposite the first frame section 104 on the other side of the midplane 16. Generally, the second frame section 105 is constructed identically to the first frame section 104. Second frame section 105 includes a center support section 127. A first angled upright 129 and a back angled upright 131 extend upwardly from the center support 127, thereby defining an enclosed triangle. This construction generally defines the base 133 of the second frame section 105. The base 133 also includes forward support plate 135 and a rearward support plate 137.

Base 132 and base 133 are rigidly connected by forward connection 118 that extends generally perpendicularly between center support sections 126 and 127. Connector 118 includes a front cross beam 138 connected at one end to a support plate 140 and at the other end to support plate 142. When the embodiment of the present invention is viewed as in FIG. 1, front cross beam 138 is considered the front and forward section of the machine 100. A rear cross beam 144 spaced from front cross beam 138 is also connected at one end to support plate 140 and at the other end to support plate 142 (not illustrated). Support plate 140 is rigidly connected to center support 126 of first frame section 104 and support plate 142 is rigidly connected to center support 127 of frame section 105.

An upper support bar 122 is provided that interconnects first frame section 104 and second frame section 105. The upper support bar 122 is also rigidly connected to rearward connector 118 by a pair of upstanding frame supports 125A and 125B. Each of the upstanding frame supports 125A and 125B are connected to one end to support plate 141 and at the other end to support plate 143. Support plate 141 is rigidly connected to front cross beam 138 and support plate 143 is rigidly connected to upper support bar 122.

Above the base 132 of the first frame section 104, there is a structure generally referred to as a workbox 146. The workbox 146 includes internal and external uprights 148A and 148B, respectively. The uprights 148A and 148B are rigidly connected to upper connector 122. An axle 150 extends between the uprights 148A and 148B and is rotatable with respect thereto via its mounting to internal and external bearings (not illustrated) carried in uprights 148A and 148B, respectively. Axle 150 is aligned at a non perpendicular angle relative to the vertical midplane 16.

A lever, designated generally by reference numeral 154, rigidly connects to axle 150. The lever 154 preferably includes upper and lower angled members 154A and 154B, respectively, and an elongated member 154C which defines a triangle with the upper and lower members 154A and 154B. Axle 150 extends through elongated member 154C and is rigidly connected thereto between opposite ends (200,201) of elongated member 154C. The lever 154 also includes an angled brace 156 extending between the axle 150 and angled members 154A and 154B, with the angled brace 156 being rigidly connected to axle 150 and member 154A. Alternatively, the axle 150 can be fixed and a bearing (not illustrated) provided in elongated member 154C and angled brace 156. The lever 154 also includes first end portion 155A, second end portion 155B and third end portion 155C.

At an end of the lever 154, particularly at the end of member 154A, a handle 164 attaches thereto. Preferably, the handle 164 includes a first portion 164A which extends rearwardly and a second portion 164B which extends generally toward the midplane 16.

Although the handle 164 is designed for ergonomics and is illustrated as fixed to the member 154A, it is possible to provide handles with a quick release in a manner known in the art to allow alternate handles to be attached for performing different exercises. These quick release handles may also include handles or straps adapted to permit an exerciser to perform leg exercises.

Elongated number 154C also includes a first connector at one end in the form of a hub 158. The hub 158 is connected to elongated member 154C near front end 200. The hub 158 extends outwardly from the midplane 16 and is adapted to hold one or more weighted plates 162 to provide a selectable weight resistance to the movement of the lever 154 in the downward direction. Similarly, the opposite end of elongated member 154C includes an outwardly extending hub 159. Hub 159 is constructed generally identically to hub 158 and is adapted to be used with a removable weighted plate 162 for applying a selectable weight resistance against movement of the handle in an upward direction.

Alternatively, the hubs 158 and 159 and associated weighted plate 162 may be replaced with, or attached to, a cable or chain, with such cable or chain operatively attached to a weighted stack via one or more pulleys, including fixed or floating pulleys when so configured the lever 154 is adapted for applying a selectable weight resistance via the use of a weighted stack held by a pulley or chain, as would be readily known by those skilled in the art of exercise machines and sometimes referred to as a "selectorized" system.

As another alternative, electromechanical resistance may be applied to the axle 150 to simulate a weight stack. Such a system is disclosed in U.S. Pat. No. 5,020,794 to Enalehardt et al. Such an arrangement also permits an individual who may be wheelchair bound to utilize the machine for therapy by selecting a desired resistance and a desired start position. Electromechanical resistance could be selectively applied to provide resistance to movement of the level 154 in either the upward or downward direction.

As still another alternative, the lever 154 may be connected at the one end to hydraulic or pneumatic devices to apply selective loading in a manner well known in the art. Each of the foregoing described embodiments can be adapted to provide a first resistance to movement of the handle 164 in the downward direction and a second resistance to movement of the handle 164 in an upward direction. These means for providing resistance include the hub and weighted plate arrangement, the electromechanical resistance devices, hydraulic and pneumatic devices above.

The first end 200 of elongated member 154C includes a cushioning material 170 to absorb shock and prevent banging of the lever 154 when it is fully rotated in the upward direction. Similarly, member 154B includes a cushioning member 170, such as a resilient material, on its end face to prevent shock when the lever 154 is fully rotated in the downward direction.

The second frame section 105 resides opposite the first frame section 104, on the other side of the midplane 16 and is structured identically to first frame section 104. For identification purposes, different reference numerals will be used to identify structure of second frame section 105 corresponding to structure found in first frame section 104. The description of the relationship between the party of first frame section 104 applies equally to the structure and function of second frame section 105. The structure of the exercise machine on the opposite side of the midplane 16 includes the following: Workbox 246, internal and external upright 248A and 248B, axle 250; internal and external bearings (not illustrated) carried in uprights 248A and 248B respectively; lever 254; upper angled member 254A; lower angled member 254B; elongated member 254C; opposite ends (202;203) of elongated member 254C; hubs 258 and 259; handle 264; cushioning member 270; angle brace 256; first end portion 255A; second end portion 255B; and third end portion 255C.

The description of the first frame section 104 as well as the movement of lever 154 and the ability to selectively apply resistance to movement of the lever 154 in either the upward and downward direction is identical to the structure and movement and resistance to movement regarding second frame section 105 and lever 254.

With respect to handles 164 and 264, the movement path of each of the handles corresponds to a vertical plane which converges toward the midplane 16 with respect to the forward facing direction of the exercise machine. Thus when the handles are in their forwardmost position, each of the handles 164,264 are closer to the midplane than when it is in its rearwardmost position. This is best illustrated by the positions of handles 164, 264 relative to the midplane 16 in FIG. 4. As illustrated, handle 164 in its rearwardmost position is a greater lateral distance from the midplane than handle 264 which is in its forward most position. This converging motion is provided by axle 150 and axle 250 being positioned at non-perpendicular angles relative to the vertical midplane 16. In the preferred embodiment, axles 150 and 250 are not parallel to the ground, rather they are angled downwardly from the outside to the inside of the machine. Alternatively, axles 150 and 250 may be parallel to the ground but be angled rearwardly such that the innermost portion of each axle is positioned farther from the front of the machine than the outermost portion of the axles, respectively.

Operation of the Multi-Purpose Exercise Machine

The operation of the multi-function exercise machine of the present invention will now be described, with particular reference to FIGS. 1–5.

In operation, the multi-function exercise machine of the present invention provides various exercises, examples of which are described below.

Rotary Lift/Rotary Pull Down

In use, an exerciser located at the exercise position 116, preferably in a standing position grasps handle 164 with both hands to perform a rotary lift. The lever 154 is loaded for lift resistance by including a plate of a selected weight on hub 159 or by the other described mechanisms for providing weight resistance to movement of the lever 154 in the upward direction. The handle 164 is lifted with a twisting motion upwardly. Similarly, to perform the "Rotary Pull Down," the lever 154 is loaded for pulling resistance by including a plate of a selected weight on hub 158 for providing resistance to the movement of lever 154 in the downward direction. Handle 164 is grasped by both hands and pulled downward in a twisting motion. To exercise the corresponding muscles on the opposite side of the body, lever 254 may be loaded and the exercises performed as described above. Although the exemplary exercises are described using plate loading on the hubs of the lever arms, it should be understood and apparent to one skilled in the art that the other methods for providing resistance to movement of the lever in either of the upward or downward direction identified and described above may be utilized.

Push/Pull Exercise

An exerciser is positioned in exercise position 116 facing forward. Lever 154 is loaded by placing a plate of a selected weight on hub 159 for providing resistance to the movement of the lever in the upward direction. Lever 254 is loaded by placing a plate of a selected weight on hub 258 for providing resistance to the movement of lever 254 in the downward direction. Each handle 164 and 264 is grasped and the exerciser pushes on handle 164 and simultaneously pulls on handle 264. The loading on levers 154 and 264 may be reversed and the exercise repeated. The other methods and devices for providing resistance to movement of the levers as previously described may alternatively be used.

Jammer

In this exercise, the exerciser is positioned in the exercise position 116 facing forward. Levers 154 and 254 are both loaded for lift resistance by placing a plate of a selected weight on hubs 159 and 259 respectively or other methods and devices are used to provide left resistance. The exerciser then grasps each handle 164 and 264 respectively and pushes on both handles simultaneously.

Shrugs

In this exercise, the exerciser is positioned in exercise position 116 facing forward. Both levers 154 and 254 are loaded for lift resistance, i.e. resistance to the movement of the levers in the upward direction. With hands at the side, the exerciser grasps each handle 164, 264 respectively and shrugs shoulders simultaneously. This exercise may be performed standing up or in a bent over position.

Pull Down

In this exercise, the exerciser is facing forward in the exercise position 116. Both levers 154 and 254 are loaded for pull down resistance, i.e. resistance to the movement of the levers in the downward direction. The handles 164 and 264 are in their forward most position and are pulled down simultaneously from a position that begins with the exerciser's hands above his head. Alternatively, this exercise may be performed by each arm individually.

Tricep Push Down

This exercise is performed with the exerciser in the exercise position 116 facing backward. One lever (154) is loaded for pull down resistance by either the hub and weighted plate method or the alternative method and devices described herein. The handle 164 is grasped with the right hand and is pushed downwardly from a starting position generally near the chest of the exerciser. The alternate lever is loaded similarly and the opposite hand is exercised. Alternatively, both levers may be loaded for pull down resistance and the exercise performed simultaneously by both arms.

Bicep Curl

This exercise is performed with one lever loaded for lift resistance. Facing backward, the exerciser, with his arms at his side grasps a handle with one hand, the palm facing upwardly, and performs a bicep curl motion. As before, the opposite lever may be loaded and the opposite arm exercised.

Any number of additional exercises could be performed, including lat pull downs, upright and bent over rowing exercises, as well as squats and calf raises. The exercises enumerated herein with respect to the multi-function exercise machine of the present invention are not intended to be limiting only exemplary.

In view of the description above, it is evident that the present invention provides a multi-function exercise machine capable of a variety of functions not previously available. Although reference has been made to particular materials of construction, configurations and operations for the purpose of explanation, it is understood that alternatives are available. It also will be apparent to those skilled in the art that various modifications and variations can be made in the design and construction of the multi-function exercise machine without departing from the scope or spirit of the invention.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

What is claimed is:

1. A multi-function exercise machine comprising:

a base structure defining an exercise station for an exerciser, the base structure positioned on an exercise surface;

a first lever provided on the base structure for pivotal movement about a first axis, said first lever having at least a first end portion, a second end portion, and a third end portion;

a handle associated with the first lever, the handle for the first lever being provided on the first end portion of the first lever so as to be engaged by the exerciser to move the handle about the first axis in an upward direction toward a raised position and in a downward direction toward a lowered position, wherein;

the second end portion of the first lever rests on the exercise surface when the handle for the first lever is in the lowered position; and the third end portion of the first lever rests on the exercise surface when the handle for the first lever is in the raised position;

a first connector provided on the second end portion of the first lever to apply selectively a resistance against movement of the handle in the upward direction; and a second connector provided on the third end portion of the first lever to apply selectively a resistance against movement of the handle in the downward direction.

2. A multi-function exercise machine as claimed in claim 1, wherein the first connector includes a first support structure extending from the second end portion of the first lever to support a weight selectively thereon and the second connector includes a second support structure extending from the third end portion of the first lever to support a weight selectively thereon.

3. A multi-function exercise machine as claimed in claim 1, wherein the first lever is counterbalanced so as to be maintained selectively in either of the raised position and the lowered position when no resistance is selectively applied thereto.

4. A multi-function exercise machine as claimed in claim 1, wherein the first axis is angled downward relative to horizontal toward the exercise station.

5. A multi-function exercise machine as claimed in claim 1, wherein the first axis is aligned at a non-perpendicular angle relative to a vertical midplane through the machine.

6. A multi-function exercise machine as claimed in claim 1, further comprising a second lever provided on the base structure for pivotal movement about a second axis, the second lever having at least a first end portion, a second end portion, and a third end portion; and a handle associated with the second lever, the handle for the second lever being provided on the first end portion of the second lever so as to be engaged by the exerciser to move the handle about the second axis in an upward direction toward a raised position and in a downward direction toward a lowered position, wherein;

the second end portion of the second lever rests on the exercise surface when the handle for the second lever is in the lowered position; and the third end portion of the second lever rests on the exercise surface when the handle for the second lever is in the raised position.

7. A multi-function exercise machine as claimed in claim 6, wherein the second lever moves independent of the first lever and the second axis is located between end portions of the second lever, and further including a third connector provided on the second end portion of the second lever to apply selectively a resistance against movement of the handle for the second lever in the upward direction, and a fourth connector provided on the third end portion of the second lever to apply selectively a resistance against movement of the handle for the second lever in the downward direction.

8. A multi-function exercise machine as claimed in claim 7, wherein each connector includes a support structure capable of supporting a weight selectively thereon.

9. A multi-function exercise machine as claimed in claim 8, wherein a vertical midplane is defined longitudinally through the exercise station between the first side and the second side, the first axis and the second axis each being aligned at a nonperpendicular angle relative to the vertical midplane.

10. A multi-function exercise machine comprising:

a base structure defining an exercise station for an exerciser, the exercise station having a first side and a second side and positioned on an exercise surface;

a first lever provided on the base structure proximate the first side of the exercise station for pivotal movement about a first axis, said first lever having at least a first end portion, a second end portion, and a third end portion;

a second lever provided on the base structure proximate the second side of the exercise station for pivotal movement about a second axis, said second lever having at least a first end portion, a second end portion, and a third end portion;

the first lever and the second lever each having a handle associated therewith, the handle for the first lever being positioned on the first end portion of the first lever so as to be engaged by the exerciser to move the handle about the first axis in an upward direction toward a raised position and in a downward direction toward a lowered position, and the handle for the second lever being positioned on the first end portion of the second lever so as to be engaged by the exerciser to move the handle about the second axis in an upward direction toward a raised position and in a downward direction toward a lowered position, wherein;

the second end portion of the first lever rests on the exercise surface when the handle for the first lever is in the lowered position;

the third end portion of the first lever rests on the exercise surface when the handle for the first lever is in the raised position;

the second end portion of the second lever rests on the exercise surface when the handle for the second lever is in the lowered position; and the third end portion of the second lever rests on the exercise surface when the handle for the second lever is in the raised position;

first means for applying a resistance against pivotal movement by the exerciser of the first lever to resist movement selectively in either of the upward direction and the downward direction;

second means for applying a resistance against pivotal movement by the exerciser of the second lever to resist movement selectively in either of the upward direction and the downward direction;

wherein the first means for applying a resistance includes a first connector provided on the second end of the first lever to apply selectively a resistance against movement of the first lever in the upward direction, and a second connector provided on the third end portion of the first lever to apply selectively a resistance against movement of the first lever in the downward direction; and the second means for applying a resistance includes a third connector provided on the second end of the second lever to apply selectively a resistance against movement of the second lever in the upward direction, and a fourth connector provided on the third end portion of the second lever to apply selectively a resistance against movement of the second lever in the downward direction.

11. A multi-function exercise machine as claimed in claim 10, wherein each connector includes a support structure capable of supporting a weight selectively thereon.

12. A multi-function exercise machine comprising:

a base structure defining an exercise station for an exerciser the exercise station having a first side and a second side and positioned on an exercise surface;

a first lever provided on the base structure proximate the first side of the exercise station for pivotal movement about a first axis, said first lever having at least a first end portion, a second end portion, and a third end portion;

a second lever provided on the base structure proximate the second side of the exercise station for pivotal movement about a second axis, said second lever having at least a first end portion, a second end portion, and a third end portion;

the first lever and the second lever each having, a handle associated therewith, the handle for the first lever being positioned on the first end portion of the first lever so as to be engaged by the exerciser to move the handle about the first axis in an upward direction toward a raised position and in a downward direction toward a lowered position, and the handle for the second lever being positioned on the first end portion of the second lever so as to be engaged by the exerciser to move the handle about the second axis in an upward direction toward a raised position and in a downward direction toward a lowered position, wherein;

the second end portion of the first lever rests on the exercise surface when the handle for the first lever is in the lowered position;

the third end portion of the first lever rests on the exercise surface when the handle for the first lever is in the raised position;

the second end portion of the second lever rests on the exercise surface when the handle for the second lever is in the lowered position; and the third end portion of the second lever rests on the exercise surface when the handle for the second lever is in the raised position;

first means for applying a resistance against pivotal movement by the exerciser of the first lever to resist movement selectively in either of the upward direction and the downward direction;

second means for applying a resistance against pivotal movement by the exerciser of the second lever to resist movement selectively in either of the upward direction and the downward direction; and wherein a vertical midplane is defined longitudinally through the exercise station between the first side and the second side, the first axis and the second axis each being aligned at a nonperpendicular angle relative to the vertical midplane.

13. A multi-function exercise machine as claimed in claim 12, wherein the first axis and the second axis each is angled downward relative to horizontal toward the exercise station.

* * * * *